United States Patent [19]

Nittaya et al.

[11] Patent Number: 4,564,954

[45] Date of Patent: Jan. 14, 1986

[54] NOISE REDUCTION CIRCUIT OF SYNTHETIC SPEECH GENERATING APPARATUS

[75] Inventors: Hiroshi Nittaya; Kosuke Nishimura, both of Yamatokoriyama, Japan

[73] Assignee: Sharp Kabushiki Kaisha, Osaka, Japan

[21] Appl. No.: 455,769

[22] Filed: Jan. 5, 1983

[30] Foreign Application Priority Data

Jan. 8, 1982 [JP] Japan ..... 57-2027

[51] Int. Cl.[4] ..... G10L 1/00

[52] U.S. Cl. ..... 381/51; 364/138; 364/574

[58] Field of Search ..... 381/51-53; 364/138, 513.5, 574

[56] References Cited

U.S. PATENT DOCUMENTS 4,387,269 6/1983 Hashimoto ..... 381/51

4,423,290 12/1983 Yoshida ..... 381/51

*Primary Examiner*—E. S. Matt Kemeny

*Attorney, Agent, or Firm*—Birch, Stewart, Kolasch & Birch

[57] ABSTRACT

A speech synthesizer may generate random sounds during die-down after power turn-off. To prevent such sound generation, the synthesizer clock circuit is grounded by an FET simultaneously with power turn-off.

5 Claims, 4 Drawing Figures

NOISE REDUCTION CIRCUIT OF SYNTHETIC SPEECH GENERATING APPARATUS

BACKGROUND OF THE INVENTION

This invention is a synthetic speech generating apparatus in which a power supply to a speech generating section, which comprises a speech synthesizer and an amplifier or the like, is cut off except during speech generation. For example, this invention relates to a noise reduction circuit for apparatuses such as speech timepieces and speech calculators or the like.

More specifically, this invention relates to a noise reduction circuit in which a logic circuit of the speech synthesizer is stopped by controlling and stopping a fundamental clock oscillator before the logic circuit of the speech synthesizer malfunctions due to a drop in the power supply voltage when the power supply to the synthetic speech generator is cut off. In other words, the invention is a noise reduction circuit which prevents noise generation immediately after completion of speech generation.

Conventionally, in synthetic speech generating apparatuses of the above type, a power controller was inserted between the speech generator and the battery power supply. By driving and stopping this controller by means of control signals from the central processing unit, savings in battery power could be obtained since power would be supplied to the speech generator only during speech generation.

However, in conventional apparatuses, there is a tendency for the power supply voltage to the speech generator to drop gradually due to the effect of the protective electrolytic capacitor connected between a power controller and the speech generator. This protective capacitor is used for the purpose of preventing speech generation from being interrupted when connections to the battery power supply are cut off for some reason while power is supplied to the synthetic speech generator.

For this reason, a problem existed in that the logic circuit of the synthetic speech generator malfunctioned when the voltage dropped below a certain value. Because output from this circuit is digital, the ON-OFF condition of the flip-flops deviate by the number of data bits provided in a subsequent stage of the circuit, causing completely irrelevant data to be supplied to the power amplifier from the flip-flop array. Furthermore, if the power amplifier is in operation during the drop in voltage, this data is amplified and emitted as noise from the speaker.

OBJECT AND SUMMARY OF THE INVENTION

It is an object of this invention to provide an improved synthetic speech generating apparatus which can effectively eliminate the noise that is generated each time a speech communication is completed.

Another object of this invention is to provide a noise reduction control circuit for synthetic speech generation apparatuses that can eliminate noise by a simple and economical means.

Other objects and applications of the present invention will become apparent from the detailed description given hereinafter. It should be understood, however, that the detailed description of and specific examples, while indicating preferred embodiments of the invention, are given by way of illustration only, since various changes and modifications within the spirit and scope of the invention will become apparent to those skilled in the art from this detailed description.

In a practical example of this invention, there is provided a synthetic speech generating apparatus which prevents noise generation due to malfunctioning of a logic circuit of a speech generator by stopping a fundamental clock oscillator of a speech synthesizer prior to malfunctioning of the logic circuit of the speech generator due to drop in power supply voltage in the speech generation apparatus when power is interrupted to the speech generator comprising the speech synthesizer and the power amplifier when not carrying out speech generation.

BRIEF DESCRIPTION OF THE INVENTION

The present invention will be better understood from the detailed description given hereinbelow and the accompanying drawings which are given by way of illustration only, and thus do not limit the present invention wherein.

DETAILED DESCRIPTION OF THE INVENTION

Figure 1:
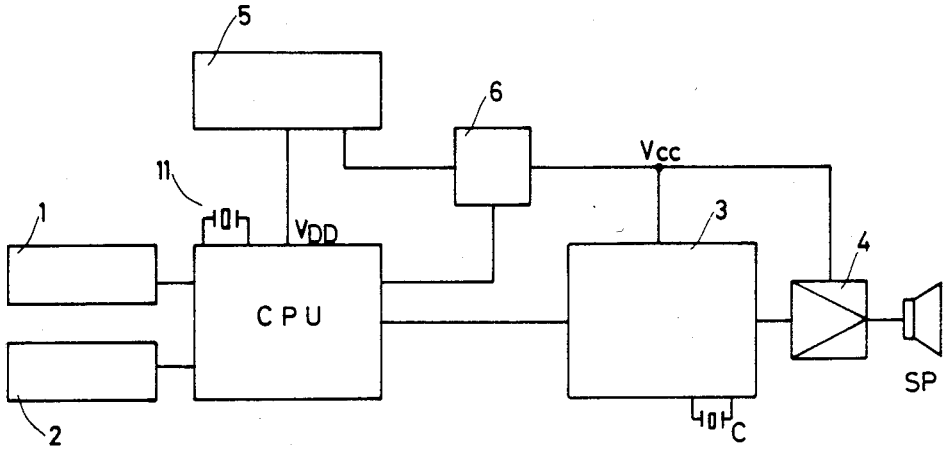
FIG. 1 is a block diagram of a speech timepiece of an embodiment according to the present invention.
Figure 2:
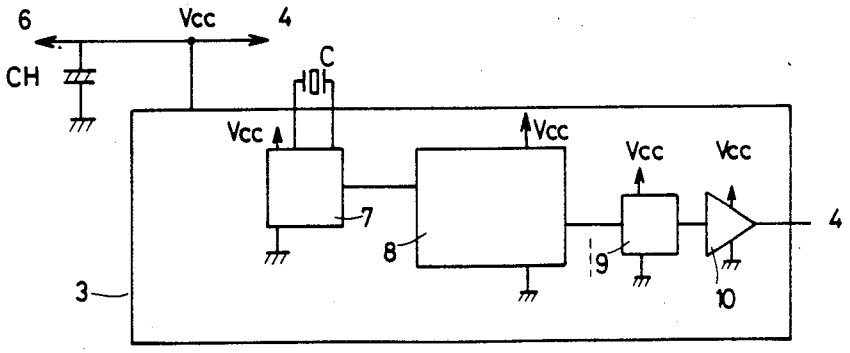
FIG. 2 is a detailed view of a speech synthesizer in the speech timepiece of an embodiment of the present invention.
Figure 3:
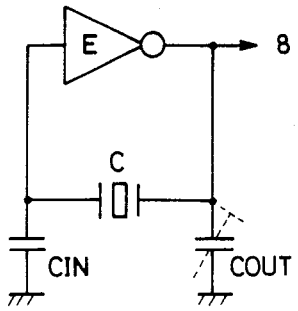
FIG. 3 is a circuit diagram of a fundamental clock generating oscillator of an embodiment of the present invention.

This invention is described as follows based on the drawings. FIG. 1 is a block diagram of a speech timepiece of an embodiment of the present invention, FIG. 2 is a detailed view of a speech synthesizer of an embodiment of the invention, and FIG. 3 is a circuit diagram of an oscillator of an embodiment of the invention.

In the drawings, a CPU (Central Processing Unit) is connected to crystal unit 11 to execute clock timing functions and alarm functions. Displayed timing information is held in display unit 1. The CPU supplies the timing information, which is speech outputted every preselected time period or which is requested by key 2, to speech synthesizer 3 of the speech generator.

The synthetic speech generator, which comprises speech synthesizer 3 and power amplifier 4, speaker "SP" through which speech data from the CPU is communicated.

DC power supply 5 is connected directly to the CPU and is also connected to speech synthesizer 3, power amplifier 4, and power controller 6. The CPU receives power from the DC power supply and remains in operating condition at all times. Speech synthesizer 3 and power amplifier 4 are arranged so that they will be activated when power controller 6 receives control signals from the CPU, that is, when power is supplied during speech generation.

The following is a slightly more detailed description of the composition of speech synthesizer 3 based on FIG. 2 and FIG. 3.

Protecting electrolytic condenser "CH" maintains a stable power supply to speech synthesizer 3 and power amplifier 4 even when the power supply conditions are unstable. Oscillator 7 is connected to crystal unit "C" and generates the fundamental clock for speech synthesizer 3. As shown in FIG. 3, fundamental clock oscillator 7 comprises an inverter "E" connected in parallel across the crystal unit "C", and capacitors "$C_{IN}$" and "$C_{OUT}$" which are connected in series for determining oscillating conditions.

Logic circuit 8 is activated by the clock of oscillator 7 and outputs speech digital data to a corresponding buffer through flip-flop unit 9 which includes a number of flip-flops equal to the number of output data bits.

Because of this composition, if power to speech synthesizer 3 and power amplifier 4 is interrupted when power controller 6 stops, the voltages impressed on these circuits will gradually drop, causing a decrease in feedback to the fundamental clock oscillator circuit, thereby causing oscillations to become gradually inoperative and to finally stop. If the capacity of capacitor "$C_{OUT}$" in the fundamental clock oscillator is made appropriately high, the oscillation stop voltage will increase together with the drift of the resonance frequency.

Therefore, according to the present invention, the malfunction voltage of logic circuit 8 and the capacity of capacitor "$C_{OUT}$" may be set so that the oscillation stop voltage is higher than the malfunction voltage. The oscillation will then stop prior to the malfunctioning of logic circuit 8 which will occur when power to the synthetic speech generator is interrupted. Simultaneously, logic circuit 8 will also stop. Thus, it may be thus possible to prevent output of irrelevant data due to malfunctioning.

Additionally, since there is a certain amount of variation in the malfunction voltage of logic circuit 8 due to irregularities in threshold voltage of transistors used in the circuit, it is convenient if a semifixed variable capacitor is used for capacitor "$C_{OUT}$".

Although the oscillation stop voltage can be made higher by increasing the capacity of one capacitor over the other capacitor forming the oscillator circuit which controls and stops logic circuit 8 before attaining the malfunction voltage, the oscillations can also be forcibly stopped simultaneously with interruption of the power supply by using a single gate FET (field effect transistor).

Figure 4:
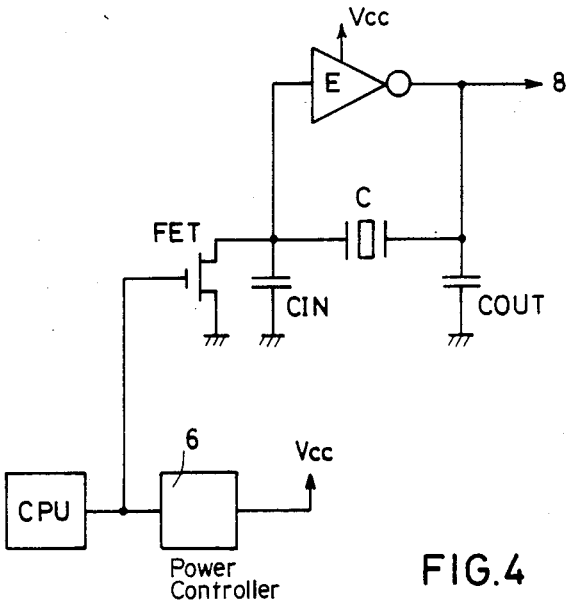
FIG. 4 is a view of another embodiment of the present invention.

FIG. 4 shows this control system using the FET. The gate of the single gate FET is connected to the lead between the CPU and power controller 6, its drain is connected to one end of crystal unit "C", and the source is grounded.

According to this circuit layout, if power interrupt instruction signals are sent to the power controller by the CPU, the single gate FET, which was in the OFF state up to this time, will be set to ON and will forcibly stop oscillations simultaneously with the interruption of the power supply. In this instance, therefore, logic circuit 8 stops at the same time when speech generation stops.

As previously explained, unwanted noise generated after each speech generation in the conventional type is eliminated in this invention because the logic circuit of the speech synthesizer is stopped before the circuit malfunctions when power to the synthetic speech generator is interrupted. In addition, noise can be eliminated easily and economically in this invention since all that is necessary is to simply change the capacity of the capacitor comprising the oscillating circuit or the simple addition of one single gate FET.

The invention being thus described, it will be obvious that the same may be varied in many ways. Such variations are not regarded as a departure from the spirit and scope of the invention, and all such modifications are intended to be included within the scope of the following claims.

What is claimed is:

1. A synthetic speech generating apparatus comprising:

synthetic speech generator means including at least a speech synthesizer, a power amplifier, a logic circuit, and an oscillator for providing a fundamental clock signal;

power supply means;

interruption means for interrupting power to said speech generator means when speech generation is not being performed; and means for stopping said logic circuit by controlling and stopping the fundamental clock oscillator of said speech synthesizer before the logic circuit malfunctions due to a drop in power supply voltage when power to the synthetic speech generator means is interrupted.

2. A synthetic speech generator apparatus according to claim 1, wherein the stopping means is forcibly executed in relation to power supply interrupt commands to the synthetic speech generator.

3. A synthetic speech generation apparatus according to claim 1, wherein said oscillator comprises capacitors to establish an oscillation condition, the capacitance of one of these capacitors being set so that said oscillator will oscillate at a voltage higher than the voltage which causes a malfunction of said logic circuit.

4. A synthetic speech generating apparatus according to claim 3, wherein one of said capacitors is an adjustable semifixed type for enabling changes in capacitance.

5. A synthetic speech generating apparatus according to claim 2, wherein a single gate FET (field effect transistor) is provided as means for stopping said logic circuit.

* * * * *